US010106874B2

(12) United States Patent
Paul et al.

(10) Patent No.: US 10,106,874 B2
(45) Date of Patent: Oct. 23, 2018

(54) HIGH STRENGTH COLD ROLLED STEEL SHEET

(71) Applicants: VOESTALPINE STAHL GMBH, Linz (AT); KOBE STEEL LTD, Hyogo (JP)

(72) Inventors: Stefan Paul, Trieben (AT); Daniel Krizan, Linz (AT); Andreas Pichler, Vocklabruck (AT); Michiharu Nakaya, Hyogo (JP)

(73) Assignees: VOESTALPINE STAHL GMBH, Linz (AT); KOBE STEEL LTD, Chuo-Ku, Kobe, Hyogo (JP)

( * ) Notice: Subject to any disclaimer, the term of this patent is extended or adjusted under 35 U.S.C. 154(b) by 569 days.

(21) Appl. No.: 14/380,941

(22) PCT Filed: Apr. 2, 2013

(86) PCT No.: PCT/EP2013/056956
§ 371 (c)(1),
(2) Date: Aug. 26, 2014

(87) PCT Pub. No.: WO2013/144376
PCT Pub. Date: Oct. 3, 2013

(65) Prior Publication Data

US 2015/0167133 A1 Jun. 18, 2015

(30) Foreign Application Priority Data

Mar. 30, 2012 (WO) ..... PCT/EP2012/055907

(51) Int. Cl.

| | |
|---|---|
| ***C22C 38/50*** | (2006.01) |
| ***C22C 38/58*** | (2006.01) |
| ***C21D 9/46*** | (2006.01) |
| ***C22C 38/00*** | (2006.01) |
| ***C22C 38/02*** | (2006.01) |
| ***C22C 38/06*** | (2006.01) |
| ***C22C 38/20*** | (2006.01) |
| ***C22C 38/22*** | (2006.01) |
| ***C22C 38/24*** | (2006.01) |
| ***C22C 38/28*** | (2006.01) |
| ***C22C 38/32*** | (2006.01) |
| ***C22C 38/38*** | (2006.01) |
| ***C21D 1/26*** | (2006.01) |
| ***C21D 6/00*** | (2006.01) |
| ***C21D 9/52*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/54*** | (2006.01) |
| *C21D 8/04* | (2006.01) |
| *C21D 1/20* | (2006.01) |

(52) U.S. Cl.

CPC ..... *C22C 38/58* (2013.01); *C21D 1/26* (2013.01); *C21D 6/004* (2013.01); *C21D 6/005* (2013.01); *C21D 6/008* (2013.01); *C21D 9/46* (2013.01); *C21D 9/52* (2013.01); *C22C 38/001* (2013.01); *C22C 38/02* (2013.01); *C22C 38/06* (2013.01); *C22C 38/20* (2013.01); *C22C 38/22* (2013.01); *C22C 38/24* (2013.01); *C22C 38/28* (2013.01); *C22C 38/32* (2013.01); *C22C 38/38* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C21D 1/20* (2013.01); *C21D 8/0436* (2013.01); *C21D 2211/001* (2013.01); *C21D 2211/002* (2013.01); *C21D 2211/005* (2013.01)

(58) Field of Classification Search

CPC ..... C22C 38/58; C22C 38/54; C22C 38/50
USPC ..... 148/661
See application file for complete search history.

(56) References Cited

U.S. PATENT DOCUMENTS

| | | | | |
|---|---|---|---|---|
| 5,470,529 | A | 11/1995 | Nomura et al. | |
| 2005/0133124 | A1* | 6/2005 | Kawano et al. | 148/546 |
| 2008/0251161 | A1 | 10/2008 | Kashima et al. | |

FOREIGN PATENT DOCUMENTS

| | | | |
|---|---|---|---|
| CN | 101928875 | A | 12/2010 |
| EP | 2327810 | A1 | 6/2011 |
| JP | 2004332099 | | 11/2004 |
| JP | 2004332099 | A | 11/2004 |
| JP | 2006002186 | A | 1/2006 |
| JP | 2011202269 | A | 10/2011 |
| JP | 2012052199 | | 3/2012 |
| KR | 1020100076409 | A | 7/2010 |
| WO | 2011118126 | | 9/2011 |
| WO | 2011148490 | | 12/2011 |

OTHER PUBLICATIONS

Machine translation of JP 2004332099, 2004.*
International Application No. PCT/EP2013/056956; Notification of Transmittal of the International Search Report and Written Opinion; dated Aug. 2, 2013; 9 pages.
Translation of Patent Abstract; Application No. 2004332099; Publication Date Nov. 25, 2004; 1 page.
European Office Action; European Application No. 13719422.1-1362; dated Sep. 26, 2016.
Japanese Office Action dated Nov. 8, 2016, for Japanese Patent Application No. 2015-502385.

(Continued)

*Primary Examiner* — Edward Johnson
(74) *Attorney, Agent, or Firm* — Karceski IP Law, PLLC

(57) ABSTRACT

The present invention relates to high strength cold rolled steel sheet suitable for applications in automobiles, construction materials and the like, specifically high strength steel sheet excellent in formability. In particular, the invention relates to cold rolled steel sheets having a tensile strength of at least 980 MPa and a method for producing such steel sheet.

16 Claims, No Drawings

(56) References Cited

OTHER PUBLICATIONS

Chinese Patent Application No. 201380016237.2; Third Office Action Comments of the Examiner; received Sep. 6, 2016; 2 pages.
Chinese Patent Application No. 201380016237.2; Second Office Action (English Translation); 9 pages.
Chinese Office Action; Application No. 201380016237.2; dated Jun. 3, 2015; 8 pages.
Chinese Office Action dated Jan. 22, 2017, for Chinese Patent Application No. 201380016237.2.

* cited by examiner

HIGH STRENGTH COLD ROLLED STEEL SHEET

CROSS-REFERENCE TO RELATED APPLICATION(S)

This is a National Stage Entry into the United States Patent and Trademark Office from International PCT patent application Ser. No. PCT/EP2013/056956, having an international filing date of Apr. 2, 2013 and to Priority patent application Ser. No. PCT/EP2012/055907 having the priority date of Mar. 30, 2012, the contents of both of which are incorporated by reference herein in their entirety.

TECHNICAL FIELD

The present invention relates to high strength cold rolled steel sheet suitable for applications in automobiles, construction materials and the like, specifically high strength steel sheet excellent in formability. In particular, the invention relates to cold rolled steel sheets having a tensile strength of at least 980 MPa.

BACKGROUND ART

For a great variety of applications increased strength levels are a pre-requisite for light weight constructions in particular in the automotive industry, since car body mass reduction results in reduced fuel consumption.

Automotive body parts are often stamped out of sheet steels, forming complex structural members of thin sheet. However, such part cannot be produced from conventional high strength steels because of a too low formability for complex structural parts. For this reason multi phase Transformation Induced Plasticity aided steels (TRIP steels) have gained considerable interest in the last years.

TRIP steels possess a multi-phase microstructure, which includes a meta-stable retained austenite phase, which is capable of producing the TRIP effect. When the steel is deformed, the austenite transforms into martensite, which results in remarkable work hardening. This hardening effect, acts to resist necking in the material and postpone failure in sheet forming operations. The microstructure of a TRIP steel can greatly alter its mechanical properties. The most important aspects of the TRIP steel microstructure are the volume percentage, size and morphology of the retained austenite phase, as these properties directly affect the austenite to martensite transformation when the steel is deformed. There are several ways in which to chemically stabilize austenite at room temperature. In low alloy TRIP steels the austenite is stabilized through its carbon content and the small size of the austenite grains. The carbon content necessary to stabilize austenite is approximately 1 wt. %. However, high carbon content in steel cannot be used in many applications because of impaired weldability.

Specific processing routs are therefore required to concentrate the carbon into the austenite in order to stabilize it at room temperature. A common TRIP steel chemistry also contains small additions of other elements to help in stabilizing the austenite as well as to aid in the creation of microstructures which partition carbon into the austenite. The most common additions are 1.5 wt. % of both Si and Mn. In order to inhibit the austenite to decompose during the bainite transformation it is generally considered necessary that the silicon content should be at least 1 wt. %. The silicon content of the steel is important as silicon is insoluble in cementite. US 2009/0238713 discloses such a TRIP steel.

However, a high silicon content can be responsible for a poor surface quality of hot rolled steel and a poor coatability of cold rolled steel. Accordingly, partial or complete replacement of silicon by other elements has been investigated and promising results have been reported for Al-based alloy design. However, a disadvantage with the use of aluminium is the rise of the transformation temperature ($A_{c3}$) which makes full austenitizing in conventional industrial annealing lines very difficult or impossible.

Depending on the matrix phase the following main types of TRIP steels are cited:

TPF TRIP Steel with Matrix of Polygonal Ferrite

TPF steels, as already mentioned before-hand, contain the matrix from relatively soft polygonal ferrite with inclusions from bainite and retained austenite. Retained austenite transforms to martensite upon deformation, resulting in a desirable TRIP effect, which allows the steel to achieve an excellent combination of strength and drawability. Their stretch flangability is however lower compared to TBF, TMF and TAM steels with more homogeneous microstructure and stronger matrix.

TBF TRIP Steel with Matrix of Bainitic Ferrite

TBF steels have been known for long and attracted a lot of interest because the bainitic ferrite matrix allows an excellent stretch flangability. Moreover, similarly to TPF steels, the TRIP effect, ensured by the strain-induced transformation of metastable retained austenite islands into martensite, remarkably improves their drawability.

TMF TRIP Steel with Matrix of Martensitic Ferrite

TMF steels also contain small islands of metastable retained austenite embedded into strong martensitic matrix, which enables these steels to achieve even better stretch flangability compared to TBF steels. Although these steels also exhibit the TRIP effect, their drawability is lower compared to TBF steels.

TAM TRIP Steel with Matrix of Annealed Martensite

TAM steels contain the matrix from needle-like ferrite obtained by re-annealing of fresh martensite. A pronounced TRIP effect is again enabled by the transformation of metastable retained austenite inclusions into martensite upon straining. Despite their promising combination of strength, drawability and stretch flangability, these steels have not gained a remarkable industrial interest due to their complicated and expensive double-heat cycle.

The formability of TRIP steels is mainly affected by the transformation characteristics of the retained austenite phase, which is in turn affected by the austenite chemistry, its morphology and other factors. In ISIJ International Vol. 50(2010), No. 1, p. 162-168 aspects influencing on the formability of TBF steels having a tensile strength of at least 980 MPa are discussed. However, the cold rolled materials examined in this document were annealed at 950° C. and the austempered at 300-500° C. for 200 s in salt bath. Accordingly, due to the high annealing temperature these materials are not suited for the production in a conventional industrial annealing line.

DISCLOSURE OF THE INVENTION

The present invention is directed to a high strength cold rolled steel sheet having a tensile strength of at least 980 MPa and having an excellent formability and a method of producing the same on an industrial scale. In particular, the invention relates to a cold rolled TBF steel sheet having properties adapted for the production in a conventional industrial annealing line. Accordingly, the steel sheet shall not only possess good formability properties but at the same time be optimized with respect to $A_{c3}$_temperature, $M_s$_temperature, austempering time and temperature and other factors such as sticky scale influencing the surface quality of the hot rolled steel sheet and the processability of the steel sheet in the industrial annealing line.

DETAILED DESCRIPTION

The invention is described in the claims.

The cold rolled high strength TBF steel sheet has a composition consisting of the following elements (in wt. %):

| | |
|---|---|
| C | 0.1-0.3 |
| Mn | 2.0-3.0 |
| Si | 0.4-1.0 |
| Cr | 0.1-0.9 |
| Si + Cr | ≥0.9 |
| Al | ≤0.8 |
| Nb | <0.1 |
| Mo | <0.3 |
| Ti | <0.2 |
| V | <0.2 |
| Cu | <0.5 |
| Ni | <0.5 |
| B | <0.005 |
| Ca | <0.005 |
| Mg | <0.005 |
| REM | <0.005 |

balance Fe apart from impurities.

The limitation of the elements is explained below.

The elements C, Mn, Si and Cr are essential to the invention for the reasons set out below:

C: 0.1-0.3%

C is an element which stabilizes austenite and is important for obtaining sufficient carbon within the retained austenite phase. C is also important for obtaining the desired strength level. Generally, an increase of the tensile strength in the order of 100 MPa per 0.1% C can be expected. When C is lower than 0.1% then it is difficult to attain a tensile strength of 980 MPa. If C exceeds 0.3% then weldability is impaired. For this reasons, preferred ranges are 0.15-0.25%, 0.15-0.19% or 0.19-0.23% depending on the desired strength level.

Mn: 2.0-3.0%

Manganese is a solid solution strengthening element, which stabilises the austenite by lowering the $M_s$ temperature and prevents ferrite and pearlite to be formed during cooling. In addition, Mn lowers the $A_{c3}$ temperature. At a content of less than 2% it might be difficult to obtain a tensile strength of 980 MPa and the austenitizing temperature might be too high for conventional industrial annealing lines. However, if the amount of Mn is higher than 3% problems with segregation may occur and the workability may be deteriorated.

Preferred ranges are therefore 2.0-2.6%, 2.1-2.5%, 2.3-2.5% and 2.3-2.7%.

Si: 0.4-1.0

Si acts as a solid solution strengthening element and is important for securing the strength of the thin steel sheet. Si is insoluble in cementite and will therefore act to greatly delay the formation of carbides during the bainite transformation as time must be given to Si to diffuse away from the bainite grain boundaries before cementite can form.

Preferred ranges are therefore 0.6-1.0%, 0.6-1.0, 0.7-0.95% and 0.75-0.90%.

Cr: 0.1-0.9

Cr is effective in increasing the strength of the steel sheet. Cr is an element that forms ferrite and retards the formation of pearlite and bainite. The $A_{c3}$ temperature and the $M_s$ temperature are only slightly lowered with increasing Cr content. Unexpected, the addition of Cr results in a strong increasing amount of stabilized retained austenite. However, due to the retardation of the bainite transformation longer holding times are required such that the processing on a conventional industrial annealing line is made difficult or impossible, when using normal line speeds. For this reason the amount of Cr is preferably limited to 0.6%. Preferred ranges are therefore 0.15-0.6%, 0.15-0.35%, 0.2-0.4% and 0.25-0.35%.

Si+Cr:≥0.9

Si and Cr when added in combination have a synergistic and completely unforeseen effect on the increased amount of residual austenite, which, in turn, results in an improved ductility. For these reasons the amount of Si+Cr is preferably limited to 1.4%. Preferred ranges are therefore 1.0-1.4%, 1.05-1.30% and 1.1-1.2%.

Mn+1.3*Cr:≤3.5

Mn and Cr delay strong the bainite formation and resulting in a high fraction of untransformed austenite with only moderate stabilization during holding in the bainite range. During cooling a large fraction of the remaining austenite transforms into martensite, resulting in the presence of large martensite/austenite particles in the final microstructure. In this case rather low hole expansion values are obtained and therefore Mn+1.3*Cr has to be limited to 3.5, preferably Mn+1.3*Cr≤3.2.

In addition to C, Mn, Si and Cr the steel may optionally contain one or more of the following elements in order to adjust the microstructure, influence on transformation kinetics and/or to fine tune one or more of the mechanical properties.

Al:≤0.8

Al promotes ferrite formation and is also commonly used as a deoxidizer. Al, like Si, is not soluble in the cementite and therefore must diffuse away from the bainite grain boundaries before cementite can form. The $M_s$ temperature is increased with an increasing Al content. A further drawback of Al is that it results in a drastic increase in the $A_{c3}$ temperature such that the austenitizing temperature might be too high for conventional CA-lines. For these reasons the Al content is preferably limited to less than 0.1%, most preferably to less than 0.06%.

Nb:<0.1

Nb is commonly used in low alloyed steels for improving strength and toughness because of its remarkable influence on the grain size development. Nb increases the strength elongation balance by refining the matrix microstructure and the retained austenite phase due to precipitation of NbC. The steel may optionally contain at least 0.015 Nb, preferably at least 0.025 Nb. At contents above 0.1% the effect is saturated.

Preferred ranges are therefore 0.01-0.08%, 0.01-0.04% and 0.01-0.03%, and even more preferred ranges are 0.02-0.08%, 0.02-0.04% and 0.02-0.03%.

Mo:<0.3

Mo can be added in order to improve the strength. Addition of Mo together with Nb results in precipitation of fine NbMoC which results in a further improvement in the combination of strength and ductility.

Ti:<0.2; V:<0.2

These elements are effective for precipitation hardening. Ti may be added in preferred amounts of 0.01-0.1%, 0.02-0.08% or 0.02-0.05%. V may be added in preferred amounts of 0.01-0.1% or 0.02-0.08%.

Cu:<0.5; Ni:<0.5

These elements are solid solution strengthening elements and may have a positive effect on the corrosion resistance. The may be added in amounts of 0.05-0.5% or 0.1-0.3% if needed.

B:<0.005

B suppresses the formation of ferrite and improves the weldability of the steel sheet. For having a noticeable effect at least 0.0002% should be added. However, excessive amounts of deteriorate the workability.

Preferred ranges are <0.004%, 0.0005-0.003% and 0.0008-0.0017%.

Ca:<0.005; Mg:<0.005; REM:<0.005

These elements may be added in order to control the morphology of the inclusions in the steel sheet and thereby improve the hole expansibility and the stretch flangability.

Preferred ranges are 0.0005-0.005% and 0.001-0.003%.

Si>Al

As Al raises the austenitization temperature more remarkably compared to Si, high strength cold rolled steel sheet according to the invention has a silicon based design, i.e. the amount of Si is larger than the amount of Al, preferably Si>1.3 Al, more preferably Si>2Al, most preferably Si>3Al or even Si>10 Al.

Si>Cr

In the steel sheets of the present invention, in particular in the steel sheets having a silicon based design, it is preferred to control the amounts of Si to be larger than the amount of Cr and to restrict the amount of Cr due to its retardation effect on the bainite transformation. For this reason it is preferred to keep Si>Cr, preferably Si>1.3 Cr, more preferably Si>1.5 Cr, even more preferably Si>2 Cr, most preferably Si>3 Cr.

The cold rolled high strength TBF steel sheet has a multiphase microstructure, comprising (in vol. %)

| | |
|---|---|
| retained austenite | 5-20 |
| bainite + bainitic ferrite + tempered martensite | ≥80 |
| polygonal ferrite | ≤10 |

The amount of retained austenite (RA) is 5-20%, preferably 5-16%. Because of the TRIP effect retained austenite is a pre-requisite when high elongation is necessary. High amount of residual austenite decreases the stretch flangability. In these steel sheets the polygonal ferrite is replace by bainitic ferrite (BF) and the microstructure generally contains more than 50% BF. The matrix consists of BF laths strengthened by a high dislocation density and between the laths the retained austenite is present. Minor amounts of martensite may be present in the final microstructure. These martensite particles are often in close contact with the retained austenite particles and are therefore called martensite-austenite (MA) particles. The size of the martensite-austenite (MA) particles shall be max 3 μm in case a high hole expansibility type of steel sheet is desired while the size may be up to 6 μm for a high elongation type of steel sheet.

The amount of retained austenite was measured by means of saturation magnetization method described in detail in Proc. Int. Conf. on TRIP-aided high strength ferrous alloys (2002), Ghent, Belgium, p. 61-64.

The size of MA particles was determined using image analysis software from light optical micrographs after LePera colour etching. This etching technique is thoroughly described e.g. in Metallography, Vol. 12 (1979), No. 3, p. 263-268.

The cold rolled high strength TBF steel sheet has the following mechanical properties

| | | |
|---|---|---|
| tensile strength ($R_m$) | ≥980 | MPa |
| total elongation ($A_{80}$) | ≥4 | % |
| hole expanding ratio (λ) | ≥20 | % |

The hole expanding ratio (λ) is preferably 25% more preferably ≥30% and even more preferred ≥40%.

The $R_m$ and $A_{80}$ values were derived according to the European norm EN 10002 Part 1, wherein the samples were taken in the longitudinal direction of the strip.

The hole expanding ratio (λ) was determined by the hole expanding test according to ISO/WD 16630. In this test a conical punch having an apex of 60° is forced into a 10 mm diameter punched hole made in a steel sheet having the size of 100×100 $mm^2$. The test is stopped as soon as the first crack is determined and the hole diameter is measured in two directions orthogonal to each other. The arithmetic mean value is used for the calculation.

The hole expanding ratio (λ) in % is calculated as follows:

$$\lambda=(Dh-Do)/Do\times 100$$

wherein Do is the diameter of the hole at the beginning (10 mm) and Dh is the diameter of the hole after the test.

The formability properties of the steel sheets were further assessed by the parameters: strength-elongation balance ($R_m \times A^{80}$) and stretch-flangability ($R_m \times \lambda$).

An elongation type steel sheet has a high strength-elongation balance and a high hole expansibility type steel sheet has a high stretch flangability.

The steel sheets of the present invention fulfil at least one of the following conditions:

| | | |
|---|---|---|
| $R_m \times A_{80}$ | ≥13 000 | MPa % |
| $R_m \times \lambda$ | ≥40 000 | MPa % |

The mechanical properties of the steel sheets of the present invention can be largely adjusted by the alloying composition and the microstructure.

According to one conceivable variant of the invention, the steel comprises 0.15-0.19 C, 2.1-2.5 Mn, 0.7-0.95 Si, 0.15-0.35 Cr. Optionally Si+Cr is regulated to ≥1.0 and further the steel may comprise 0.02-0.03 Nb. The steel sheet fulfils at least one of the following requirements:

($R_m$)=980-1200 MPa, ($A_{80}$)≥6, preferably 7%, (λ)≥20%, preferably ≥40% and further at least one of:

$R_m \times A_{80}$≥13 000 MPa % and $R_m \times \lambda$≥40 000 MPa %, preferably ≥50 000 MPa %. A typical chemical composition may comprise 0.17 C, 2.3 Mn, 0.85 Si, 0.25 Cr, max 0.025 Nb, rest Fe apart from impurities.

According to another conceivable variant of the invention the steel comprises 0.19-0.23 C, 2.3-2.7 Mn, 0.7-0.95 Si, 0.2-0.4 Cr. Optionally Si+Cr is regulated to ≥1.1 and further the steel may comprise 0.01-0.03 Nb. The steel sheet fulfils at least one of the following requirements:

($R_m$)=1180-1500 MPa, ($A_{80}$)≥6, preferably 7%, (λ)≥20%, preferably ≥31% and further at least one of:

$R_m \times A_{80} \geq 13\ 000$ MPa % and $R_m \times \lambda \geq 40\ 000$ MPa %, preferably ≥45 000 MPa %. A typical chemical composition may comprise 0.21 C, 2.5 Mn, 0.85 Si, 0.3 Cr, 0.07 Mo, max 0.025 Nb, rest Fe apart from impurities.

The steel sheets of the present invention can be produced in a conventional industrial annealing line. The processing comprises the steps of:

a) providing a cold rolled steel strip having a composition as set out above b) annealing the cold rolled strip at an annealing temperature, $T_{an}$, above the $A_{c3}$ temperature in to fully austenitizing the steel, followed by c) cooling the cold rolled steel strip in particular from 680-750° C. to a cooling stop temperature of rapid cooling, $T_{RC}$, in the range of 320-475° C. at a cooling rate sufficient to avoid the ferrite formation, the cooling rate being 20–100° C./s, followed by d) austempering the cold rolled steel strip at an austempering tempering, $T_{OA}$, being in the range of $T_{MS}$−60° C. to $T_{MS}$+90° C., and e) cooling the cold rolled steel strip to ambient temperature.

The process shall preferably comprise the following steps:

in step b) the annealing being performed at 840-860° C., during an annealing holding time, $t_{an}$, of up to 100 s, preferably 20-80 s, in step c) the cooling being performed at a first cooling rate, CR1, of about 3-20° C./s from the annealing temperature, $T_{an}$, to the stop temperature of slow cooling, $T_{SC}$, which is between 680 to 750° C., and a second cooling rate, CR2, which is between 20 to 100° C./s, to the stop temperature of rapid cooling, $T_{RC}$, and in step d) the austempering being performed at a temperature, $T_{OA}$, which is between 350 and 475° C. and a time interval, $t_{OA}$, of 150-450 s, preferably 280-320 s.

Preferably, no external heating is applied to the cold rolled steel strip between step c) and d).

The reasons for regulating the heat treatment conditions are set out below:

Annealing temperature, $T_{an}$, $>A_{c3}$ temperature:

By fully austenitizing the steel the amount of polygonal ferrite can be controlled. If the annealing temperature, $T_{an}$, is below the $A_{c3}$ temperature there is a risk that the amount of polygonal ferrite will exceed 10%. Too much polygonal ferrite gives larger size of the MA constituent.

Cooling stop temperature of rapid cooling, $T_{RC}$, in the range of 320-475° C.:

By controlling the cooling stop temperature of rapid cooling, $T_{RC}$, to a temperature that is between 320 and 475° C. the size of MA constituent and the amount of retained austenite, RA, can be controlled. If the cooling stop temperature of rapid cooling, $T_{RC}$, exceeds the temperature range, the size of MA constituent will become larger and the amount of RA will become lower. Furthermore, if $T_{RC}$ is lower than the above-mentioned temperature range, the amount of RA will become lower. Both situations will result in a deterioration of uniform and total elongation of the steel sheet.

Austempering temperature $T_{OA}$, being in the range of $T_{MS}$−60° C. to $T_{MS}$+90° C.:

By controlling the austempering temperature, $T_{OA}$, to a temperature that is between $T_{MS}$−60° C. to $T_{MS}$+90° C., preferably $T_{MS}$−60° C. to $T_{MS}$+80° C., the amount of retained austenite, RA, can be controlled. A lower austempering temperature, $T_{OA}$, will lower the amount of RA. A higher austempering temperature, $T_{OA}$, will lower the amount of RA and increase the size of MA constituent. Similarly to $T_{RC}$, both situations will lower the uniform elongation, Ag, and the total elongation, $A_{80}$, of the steel sheet.

First and second cooling rates, CR1, CR2:

By controlling the first cooling rate, CR1, to about 3-20° C./s, from the annealing temperature, $T_{an}$, to the stop temperature of slow cooling, $T_{SC}$, in a temperature range that is between 680 and 750° C., and a second cooling rate, CR2, of −20-100° C./s, to the stop temperature of rapid cooling, $T_{RC}$, the amount of polygonal ferrite can be controlled. Lowering the cooling rate CR2 will increase the amount of polygonal ferrite to more than 10%. The first cooling rate CR1 stems from the lay-out of many annealing lines and per se, it does not have the direct impact on the microstructure and mechanical properties of the steel sheet. However, as a part of annealing line, this cooling rate has to be correctly adjusted that the entire annealing cycle can be accomplished.

In one embodiment of the invention the steel sheet is a high elongation type steel sheet having a strength-elongation balance $R_m \times A_{80} \geq 13\ 000$ MPa %, preferably ≥13 500 MPa %, most preferably ≥14 000 MPa %. In that case, step d) is performed at an austempering temperature of $T_{Ms}$−30° C. to $T_{Ms}$+90° C., e.g. $T_{Ms}$−30° C. to 475° C., preferably $T_{Ms}$−10° C. to 440° C.

In another embodiment of the invention the steel sheet is a high hole expansibility type steel sheet having stretch-flangability $R_m \times \lambda \geq 40\ 000$ MPa %, preferably ≥50 000 MPa %, most preferably ≥55 000 MPa %, step d) being performed at an austempering temperature of $T_{Ms}$−60° C. to $T_{Ms}$+30° C., preferably $T_{Ms}$−60° C. to 400° C., more preferably $T_{Ms}$−60° C. to 380° C.

EXAMPLES

A number of test alloys 1-14 were manufactured having chemical compositions according to table I. Steel sheets were manufactured and subjected to heat treatment in a conventional CA-line according to the parameters specified in Table II. The microstructure of the steel sheets was examined along with a number of mechanical properties and the result is presented in Table III.

In the column MA size $d_{MA}$, the grain size of martensite-austenite particles measured by means of image analysis is given, wherein the MA size is divided into three main classes:

Small, wherein the size of MA particles $d_{MA} \leq 3$ μm,

Middle, wherein 3 μm$<d_{MA}<$6 μm,

Large, wherein $d_{MA} \geq 6$ μm.

In the column cementite, N denotes that an almost negligible amount of cementite can be found in the microstructure, whereas Y indicates that a significant amount of harmful cementite is present in the final microstructure.

The positive influence of chromium on the microstructure and the mechanical properties is evident when comparing the results of the inventive steel sheet with the results of the steel sheets 10 and 11 which do not contain chromium in the claimed range. The experiments No. 28-33 in Table III shows that in some cases the amount of residual austenite was too low (No. 28, 29 and 31) and that the microstructure contained some cementite.

From the results for the steel sheet No. 10 having 0.6% Si and steel sheet No. 11 having 0.82% Si but without the addition of Cr it is apparent that the Si content is too low for preventing the formation of cementite during the bainitic transformation. A completely different behaviour is found for the inventive steel sheets. Hence, it would appear that Cr acts similarly to Si in the retardation or prevention of the cementite precipitation. Partly based on these results the claimed TBF steel having a Si-based alloy design with additions of Cr having improved workability for the production in a continuous annealing line was developed.

For the steel sheet No. 12 reasonable mechanical properties were obtained. However, surface investigations indicated that in comparison to low Si material showed a significantly higher coverage of the surface with Si-oxides which increases the risk of pickle formation on the rolls during annealing and therefore this material is beyond the scope of this invention.

From the results of steel sheet No. 13 having 0.62% Si and 0.14 Cr which does not satisfy Si+Cr≥0.9, the synergetic effect of Si and Cr is too low to ensure appropriate elongation and hole expansion in order to fulfil the preceding claims in terms of $R_m \times A_{80}$ and $R_m \times \lambda$, respectively (example No. 37 in Table III).

From the results for steel sheet type No. 14 with a Cr>Si content and simultaneously the Mn+1.3*Cr>3.5 by applying annealing cycle 3 from table II, low hole expansion values were obtained (No. 42 in table III). As already mentioned, such high Mn and Cr contents result in a strong delay of the bainite formation during austempering stage. Hence the microstructure containing a large fraction of MA particles is obtained, which results in rather poor hole expansion behaviour.

The steel sheet No. 6 was subjected to the annealing outside the claimed range of austempering temperatures, namely by a low austempering temperature of 325° C. (heat cycle No. 6) and a high austempering temperature, $T_{OA}$, of 485° C. (heat cycle No. 7). The results of this annealing are given in table III in example No. 38 and 39, respectively. Low austempering temperature resulted in very low elongation, Rp0.2, due to an insufficient amount of retained austenite, RA, as the consequence of a slow redistribution of C into austenite and a stronger driving force for the iron carbide precipitation in martensite. For the high austempering temperature the partial decomposition of austenite into ferrite and cementite could not be suppressed, resulting in a low amount of stabilized retained austenite.

A further comparative example represents heat cycle No. 8 with an annealing temperature, $T_{an}$, of 780° C. This low intercritical annealing resulted in a considerably high amount of ferrite and therefore moderate hole expansion performance (example No. 40 in table III).

An example with a cooling rate of 10° C./s is given table II cycle No. 9. As can be seen such a low cooling rate resulted in the ferrite formation during cooling from annealing temperature to the austempering stage and therefore moderate hole expansion performance (table III example No. 41).

TABLE I

| Chemical composition in wt. % | | | | | | | | | | | |
|---|---|---|---|---|---|---|---|---|---|---|---|
| Steel type No. | C | Si | Mn | Cr | Nb | P | S | Al | Ni | Mo | Cu |
| 1 | 0.182 | 0.85 | 2.29 | 0.28 | 0.001 | 0.0074 | 0.0006 | 0.038 | 0.005 | 0.029 | 0.016 |
| 2 | 0.173 | 0.80 | 2.34 | 0.200 | <0.002 | 0.0049 | 0.0037 | 0.018 | 0.012 | 0.003 | 0.014 |
| 3 | 0.172 | 0.78 | 2.29 | 0.370 | <0.002 | 0.0045 | 0.0026 | 0.018 | 0.009 | 0.003 | 0.015 |
| 4 | 0.177 | 0.79 | 2.29 | 0.310 | 0.025 | 0.005 | 0.0040 | 0.016 | 0.010 | 0.003 | 0.014 |
| 5 | 0.176 | 0.79 | 2.19 | 0.320 | <0.002 | 0.0050 | 0.0018 | 0.030 | 0.012 | 0.003 | 0.014 |
| 6 | 0.200 | 0.83 | 2.52 | 0.310 | <0.002 | 0.0033 | 0.0020 | 0.054 | 0.014 | 0.075 | 0.015 |
| 7 | 0.220 | 0.83 | 2.45 | 0.610 | <0.002 | 0.0036 | 0.0013 | 0.049 | 0.014 | 0.073 | 0.013 |
| 8 | 0.220 | 0.98 | 2.46 | 0.610 | <0.002 | 0.0042 | 0.0009 | 0.048 | 0.009 | 0.073 | 0.014 |
| 9 | 0.154 | 0.81 | 2.48 | 0.620 | <0.002 | 0.0040 | 0.0010 | 0.045 | 0.014 | 0.076 | 0.014 |
| 10 | 0.210 | 0.61 | 2.50 | 0.018 | <0.001 | 0.0048 | 0.0013 | 0.030 | 0.011 | 0.071 | 0.013 |
| 11 | 0.199 | 0.82 | 2.50 | 0.017 | <0.001 | 0.0064 | 0.0016 | 0.058 | 0.013 | 0.070 | 0.014 |
| 12 | 0.200 | 1.44 | 2.50 | 0.044 | 0.002 | 0.0050 | 0.0003 | 0.054 | 0.012 | 0.076 | 0.012 |
| 13 | 0.21 | 0.62 | 2.48 | 0.14 | 0.002 | 0.0062 | 0.0021 | 0.049 | 0.013 | 0.003 | 0.017 |
| 14 | 0.196 | 0.56 | 2.9 | 0.7 | <0.002 | 0.0054 | 0.0031 | 0.046 | 0.012 | 0.004 | 0.016 |

| Steel type No. | V | B | Ti | N | Invention | Ms, ° C. | Ac3, ° C. | Mn+1,3*Cr |
|---|---|---|---|---|---|---|---|---|
| 1 | 0.002 | 0.0004 | 0.002 | 0.0044 | Y | 379 | 794 | 2.65 |
| 2 | 0.002 | <0.0002 | 0.002 | 0.0051 | Y | 383 | 791 | 2.60 |
| 3 | 0.002 | <0.0002 | 0.003 | 0.0041 | Y | 383 | 792 | 2.77 |
| 4 | 0.002 | <0.0002 | 0.002 | 0.0042 | Y | 382 | 791 | 2.69 |
| 5 | 0.002 | <0.0002 | 0.002 | 0.0040 | Y | 385 | 795 | 2.61 |
| 6 | 0.001 | 0.0003 | 0.002 | 0.0036 | Y | 364 | 783 | 2.92 |
| 7 | 0.001 | 0.0002 | 0.002 | 0.0041 | Y | 354 | 781 | 3.24 |
| 8 | 0.001 | 0.0002 | 0.002 | 0.0049 | Y | 352 | 787 | 3.25 |
| 9 | 0.002 | 0.0003 | 0.003 | 0.0036 | Y | 381 | 795 | 3.29 |
| 10 | 0.001 | 0.0004 | 0.003 | 0.0043 | N | 367 | 771 | 2.52 |
| 11 | 0.001 | 0.0004 | 0.003 | 0.0053 | N | 369 | 783 | 2.52 |
| 12 | 0.003 | 0.0002 | 0.003 | 0.0031 | N | 361 | 811 | 2.56 |
| 13 | 0.002 | <0.0002 | 0.002 | 0.0042 | N | 366 | 770 | 2.66 |
| 14 | 0.002 | 0.0002 | 0.003 | 0.0045 | N | 353 | 758 | 3.81 |

Ref.: K. W. Andrews, JISI, vol. 203, 1965 p. 721:

Ms = 539—423C—30.4Mn—17.7Ni—12.1Cr—7.5Mo—11Si

Ac3 = 910-203$C^{1/2}$—15.2Ni—30Mn + 44.7Si + 104V + 31.5Mo + 13.1W

TABLE II

| Heat cycle No. | Heating rate HR, ° C./s | Annealing temperature Tan, ° C. | Annealing time tan, s | Cooling rate CR1, ° C./s | Stop temperature of slow cooling $T_{SC}$, ° C. | Cooling rate CR2, ° C./s | Stop temperature of rapid cooling $T_{RC}$, ° C. | Overageing temperature $T_{OA}$, ° C. | Overageing time $t_{OA}$, s | Cooling rate CR3, ° C./s |
|---|---|---|---|---|---|---|---|---|---|---|
| 1 | 20 | 850 | 60 | 8 | 700 | 50 | 350 | 350 | 300 | 30 |
| 2 | 20 | 850 | 60 | 8 | 700 | 50 | 375 | 375 | 300 | 30 |
| 3 | 20 | 850 | 60 | 8 | 700 | 50 | 400 | 400 | 300 | 30 |
| 4 | 20 | 850 | 60 | 8 | 700 | 50 | 450 | 450 | 300 | 30 |
| 5 | 20 | 850 | 60 | 8 | 700 | 50 | 350 | 400 | 300 | 30 |
| 6 | 20 | 850 | 60 | 8 | 700 | 50 | 325 | 325 | 300 | 30 |
| 7 | 20 | 850 | 60 | 8 | 700 | 50 | 485 | 485 | 300 | 30 |
| 8 | 20 | 780 | 60 | 8 | 700 | 50 | 400 | 400 | 300 | 30 |
| 9 | 20 | 850 | 60 | 8 | 700 | 10 | 400 | 400 | 400 | 30 |

TABLE III

| | | | Metal structure | | | | | Mechanical properties | | | | | | | Hole expansion punched | |
|---|---|---|---|---|---|---|---|---|---|---|---|---|---|---|---|---|
| No. | Heat cycle No | Steel No. | Bainite + bainitic ferrite + tempered martensite, vol. % | Polygonal ferrite, vol. % | Retained austenite, vol. % | MA size $d_{MA}$ | Cementite Y/N | Rp0.2, MPa | Rm, MPa | Ag, % | A80, % | Rp0.2/Rm, — | Rm * A80, MPa * % | λ, % | Rm * λ, MPa * % | Invention Y/N |
| 1 | 1 | 1 | 94.9 | 0 | 5.1 | small | N | 922 | 1198 | 5.2 | 7.2 | 0.77 | 8626 | 61 | 73078 | Y |
| 2 | 2 | 1 | 94.8 | 0 | 5.2 | small | N | 915 | 1145 | 5.9 | 7.5 | 0.80 | 8588 | 46 | 52670 | Y |
| 3 | 3 | 1 | 91.0 | 0 | 9.0 | middle | N | 765 | 1050 | 7.7 | 13 | 0.73 | 13650 | 29 | 30450 | Y |
| 4 | 4 | 1 | 85.5 | 0 | 14.5 | middle | N | 520 | 985 | 11.1 | 15 | 0.53 | 14625 | 20 | 19500 | Y |
| 5 | 5 | 1 | 89.7 | 0 | 10.3 | small | N | 826 | 1060 | 8.6 | 13.5 | 0.78 | 14310 | 56 | 59360 | Y |
| 6 | 1 | 2 | 94.8 | 0 | 5.2 | small | N | 907 | 1191 | 5.5 | 7.1 | 0.76 | 8456 | 58 | 69078 | Y |
| 7 | 2 | 2 | 94.0 | 0 | 6.0 | small | N | 908 | 1116 | 4.9 | 6.8 | 0.81 | 7589 | 50 | 55800 | Y |
| 8 | 1 | 3 | 94.5 | 0 | 5.5 | small | N | 968 | 1218 | 4.9 | 6.7 | 0.79 | 8161 | 63 | 76734 | Y |
| 9 | 2 | 3 | 94.0 | 0 | 6.0 | small | N | 916 | 1156 | 5.0 | 7.2 | 0.79 | 8323 | 62 | 71672 | Y |
| 10 | 3 | 3 | 92.5 | 0 | 7.5 | small | N | 820 | 1051 | 7.1 | 11.5 | 0.78 | 12087 | 43 | 45193 | Y |
| 11 | 1 | 4 | 84.0 | 10 | 6.0 | small | N | 901 | 1130 | 5.8 | 7.5 | 0.80 | 8475 | 59 | 66670 | Y |
| 12 | 2 | 4 | 83.5 | 10 | 6.5 | small | N | 898 | 1092 | 5.9 | 7.5 | 0.82 | 8190 | 55 | 60060 | Y |
| 13 | 3 | 4 | 80.5 | 10 | 9.5 | middle | N | 804 | 985 | 8.8 | 14.8 | 0.82 | 14578 | 35 | 34475 | Y |
| 14 | 1 | 5 | 87.0 | 8 | 5.0 | small | N | 921 | 1150 | 4.9 | 6.9 | 0.80 | 7935 | 48 | 55200 | Y |
| 15 | 2 | 5 | 86.5 | 8 | 5.5 | small | N | 840 | 1098 | 4.3 | 6.2 | 0.77 | 6808 | 40 | 43920 | Y |
| 16 | 1 | 6 | 94.0 | 0 | 6.0 | small | N | 1020 | 1362 | 5.0 | 6.2 | 0.75 | 8444 | 44 | 59928 | Y |
| 17 | 2 | 6 | 90.6 | 0 | 9.4 | small | N | 904 | 1260 | 7.0 | 8.4 | 0.72 | 10584 | 38 | 47880 | Y |
| 18 | 3 | 6 | 88.6 | 0 | 11.4 | middle | N | 748 | 1185 | 9.5 | 11.4 | 0.63 | 13509 | 25 | 29625 | Y |
| 19 | 4 | 6 | 89.9 | 0 | 10.1 | middle | N | 742 | 1350 | 8.2 | 10.1 | 0.55 | 13635 | 22 | 29700 | Y |
| 20 | 1 | 7 | 91.6 | 0 | 8.4 | small | N | 944 | 1398 | 5.5 | 6.6 | 0.68 | 9227 | 40 | 55920 | Y |
| 21 | 2 | 7 | 88.5 | 0 | 11.5 | small | N | 846 | 1342 | 7.4 | 8.4 | 0.63 | 11273 | 32 | 42944 | Y |
| 22 | 3 | 7 | 85.7 | 0 | 14.3 | middle | N | 745 | 1347 | 9.2 | 11.1 | 0.55 | 14952 | 23 | 30981 | Y |
| 23 | 1 | 8 | 91.2 | 0 | 8.8 | small | N | 926 | 1410 | 6.1 | 7.2 | 0.66 | 10152 | 38 | 53580 | Y |
| 24 | 2 | 8 | 88.0 | 0 | 12.0 | small | N | 848 | 1348 | 8.0 | 9.9 | 0.63 | 13345 | 31 | 41788 | Y |
| 25 | 3 | 8 | 86.4 | 0 | 13.6 | middle | N | 748 | 1360 | 9.4 | 11.4 | 0.55 | 15504 | 23 | 31280 | Y |
| 26 | 1 | 9 | 93.5 | 0 | 6.5 | small | N | 880 | 1182 | 5.5 | 6.5 | 0.74 | 7683 | 39 | 46098 | Y |
| 27 | 2 | 9 | 91.6 | 0 | 8.4 | small | N | 841 | 1204 | 6.5 | 7.6 | 0.70 | 9150 | 34 | 40936 | Y |
| 28 | 1 | 10 | 97.0 | 0 | 3.0 | small | Y | 976 | 1275 | 4.5 | 5.4 | 0.77 | 6885 | 27 | 34425 | N |
| 29 | 2 | 10 | 96.6 | 0 | 3.4 | small | Y | 875 | 1204 | 4.8 | 5.7 | 0.73 | 6863 | 24 | 28896 | N |
| 30 | 3 | 10 | 93.5 | 0 | 6.5 | middle | Y | 825 | 1043 | 6.2 | 8.0 | 0.79 | 8344 | 16 | 16688 | N |
| 31 | 1 | 11 | 96.0 | 0 | 4.0 | small | Y | 978 | 1368 | 4.7 | 5.6 | 0.71 | 7661 | 29 | 39672 | N |
| 32 | 2 | 11 | 92.5 | 0 | 7.5 | small | Y | 876 | 1246 | 5.0 | 6.0 | 0.70 | 7476 | 26 | 32396 | N |
| 33 | 3 | 11 | 88.5 | 0 | 11.5 | middle | Y | 757 | 1175 | 8.1 | 9.9 | 0.64 | 11633 | 19 | 22325 | N |
| 34 | 1 | 12 | 92.9 | 0 | 7.1 | small | N | 978 | 1347 | 5.2 | 6.1 | 0.73 | 8217 | 45 | 60615 | N |
| 35 | 2 | 12 | 89.5 | 0 | 10.5 | small | N | 908 | 1256 | 7.1 | 9.6 | 0.72 | 12058 | 38 | 47728 | N |
| 36 | 3 | 12 | 87.0 | 0 | 13.0 | middle | N | 781 | 1208 | 9.2 | 11.1 | 0.65 | 13409 | 21 | 25368 | N |
| 37 | 3 | 13 | 92.7 | 0 | 7.3 | small | Y | 812 | 1051 | 6.5 | 8.4 | 0.77 | 8828.4 | 18 | 18918 | N |
| 38 | 6 | 6 | 94.5 | 0 | 4.5 | small | N | 1056 | 1394 | 4.3 | 5.2 | 0.76 | 7248.8 | 41 | 57154 | N |
| 39 | 7 | 6 | 96.9 | 0 | 3.1 | large | Y | 792 | 1382 | 5.2 | 7.1 | 0.57 | 9812.2 | 20 | 27640 | N |
| 40 | 8 | 6 | 59.6 | 27 | 13.4 | middle | N | 578 | 1057 | 14.8 | 17.4 | 0.55 | 18391.8 | 12 | 12684 | N |
| 41 | 9 | 6 | 55.2 | 31 | 13.8 | middle | N | 567 | 1034 | 14.2 | 17.3 | 0.55 | 17888.2 | 11 | 11374 | N |
| 42 | 3 | 14 | 83.1 | 0 | 16.9 | large | N | 708 | 1432 | 6.7 | 7.8 | 0.49 | 11169.6 | 9 | 12888 | N |

INDUSTRIAL APPLICABILITY

The present invention can be widely applied to high strength steel sheets having excellent formability for vehicles such as automobiles.

The invention claimed is:

1. A high strength cold rolled TRIP steel sheet with a matrix of bainitic ferrite having, a) a composition consisting of the following elements, in wt. %:

| | |
|---|---|
| C | 0.1-0.19 |
| Mn | 2.0-3.0 |
| Si | 0.4-0.9 |
| Cr | 0.2-0.6 |
| Si + Cr | 0.9-1.3 |
| Si/Cr | >2 |
| Al | ≤0.06 |
| Nb | <0.1 |
| Mo | <0.3 |
| Ti | <0.2 |
| V | <0.2 |
| Cu | <0.5 |
| Ni | <0.5 |
| B | <0.005 |
| Ca | <0.005 |
| Mg | <0.005 |
| REM | <0.005 |
| S | <0.01 |
| P | <0.02 |
| N | <0.02 |

balance Fe apart from impurities, b) a multiphase microstructure comprising, in vol. %

| | |
|---|---|
| retained austenite | 5-20 |
| bainitic ferrite | >50 |
| bainite + bainitic ferrite + tempered martensite | ≥80 |
| polygonal ferrite | ≤10 |

wherein the maximum size of martensite-austenite particles (MA) is ≤6 μm, c) at least one of the following mechanical properties

| | |
|---|---|
| a tensile strength ($R_m$) | 980-1200 MPa |
| an elongation ($A_{80}$) | ≥6% |
| a hole expanding ratio (λ) | ≥40% |

and fulfilling the following conditions

| | |
|---|---|
| $R_m \times A_{80}$ | ≥13 000 MPa % |
| $R_m \times \lambda$ | ≥40 000 MPa %. |

2. The high strength cold rolled TRIP steel sheet according to claim 1 wherein at least one of the following elements is in the composition, in wt. %:

| | |
|---|---|
| C | 0.15-0.19 |
| Mn | 2.0-2.6 |
| Si | 0.6-0.9. |

3. The high strength cold rolled TRIP steel sheet according to claim 1, wherein at least one of the following elements is in the composition, in wt. %:

| | |
|---|---|
| Nb | 0.02-0.08 |
| Mo | 0.05-0.3 |
| Ti | 0.02-0.08 |
| V | 0.02-0.1 |
| Cu | 0.05-0.4 |
| Ni | 0.05-0.4 |
| B | 0.0005-0.003 |
| Ca | 0.0005-0.005 |
| Mg | 0.0005-0.005 |
| REM | 0.0005-0.005. |

4. The high strength cold rolled TRIP steel sheet according to claim 1, wherein:

Ti>3.4N.

5. The high strength cold rolled TRIP steel sheet according to according to claim 1, wherein the maximum size of martensite-austenite particles (MA) is ≤3 μm.

6. The high strength cold rolled TRIP steel sheet according to claim 1, wherein the multiphase microstructure comprising, in vol. %:

retained austenite 5-16.

7. The high strength cold rolled TRIP steel sheet according to claim 1, wherein the composition consists of:

| | |
|---|---|
| C | 0.15-0.19 |
| Mn | 2.1-2.5 |
| Si | 0.7-0.9 |
| Cr | 0.2-0.35 |

optionally

| | |
|---|---|
| Si + Cr | ≥1.0 |
| Nb | 0.02-0.03 |

and wherein the steel sheet fulfils at least one of the following requirements $(A_{80})>7\%$ and $R_m \times \lambda \geq 50\ 000$ MPa %.

8. The high strength cold rolled TRIP steel sheet according to claim 1, wherein the composition consists of:

| | |
|---|---|
| C | 0.19-0.23 |
| Mn | 2.3-2.6 |
| Si | 0.7-0.95 |
| Cr | 0.2-0.4 |

optionally

| | |
|---|---|
| Si + Cr | ≥1.1 |
| Nb | 0.02-0.03 |

and wherein the steel sheet fulfils the following requirements

| | |
|---|---|
| ($R_m$) | 1180-1500 MPa |
| (λ) | ≥31% |

and preferably fulfilling the following condition $R_m \times \lambda \geq 40\ 000$ MPa %.

9. The high strength cold rolled TRIP steel sheet according to claim 1, wherein the ratio (Mn+1.3*Cr)≤3.5.

10. The high strength cold rolled TRIP steel sheet according to claim 1, which is not provided with a hot dip galvanizing layer.

11. The high strength cold rolled TRIP steel sheet according to claim 1, wherein the composition consists of at least one of the following elements, in wt. %:

| | |
|---|---|
| S | ≤0.003 |
| P | ≤0.012 |
| N | ≤0.005. |

12. The high strength cold rolled TRIP steel sheet according to claim 9, wherein the ratio (Mn+1.3*Cr)≤3.2.

13. The high strength cold rolled TRIP steel sheet according to claim 1, wherein Si>10 Al.

14. The high strength cold rolled TRIP steel sheet according to claim 1, wherein Si>3 Cr.

15. The high strength cold rolled TRIP steel sheet according to claim 8, wherein $(A_{80})>7\%$.

16. The high strength cold rolled TRIP steel sheet according to claim 8, wherein $R_m x\lambda>45\ 000$ MPa %.

* * * * *